US006305671B1

(12) United States Patent
Valentine

(10) Patent No.: US 6,305,671 B1
(45) Date of Patent: Oct. 23, 2001

(54) ATTACHMENT BRACKET

(75) Inventor: Heath E. Valentine, Middletown, OH (US)

(73) Assignee: Valentine & Company, Middletown, OH (US)

( * ) Notice: Subject to any disclaimer, the term of this patent is extended or adjusted under 35 U.S.C. 154(b) by 0 days.

(21) Appl. No.: 09/237,364

(22) Filed: Jan. 26, 1999

(51) Int. Cl.[7] ..... E04H 17/14
(52) U.S. Cl. ..... 256/65; 256/68
(58) Field of Search ..... 256/59, 65, 66, 256/67, 68, 69, 70, 21, 22, 60; 493/297, 252, 235, 240, 255, 374.1, 374.3

(56) References Cited

U.S. PATENT DOCUMENTS 3,338,602 * 8/1967 Arnd ..... 403/252
3,489,392 * 1/1970 Thom ..... 256/65
3,574,367 * 4/1971 Jankowski et al. ..... 403/297 X
3,822,053 * 7/1974 Daily ..... 256/21 X
3,910,562 * 10/1975 Helterbrand ..... 256/22 X
4,063,836 * 12/1977 Miltano ..... 256/65 X
4,101,226 * 7/1978 Parisen ..... 256/65 X
4,104,000 * 8/1978 Fleischmann ..... 403/297 X
4,556,337 * 12/1985 Marshall ..... 403/255
4,691,897 * 9/1987 Frush ..... 256/65
4,898,365 * 2/1990 Conner et al. ..... 256/22 X
4,907,388 * 3/1990 Siahatgar ..... 403/252 X
5,657,604 * 8/1997 Mallot ..... 403/252 X
5,882,001 * 3/1999 Reinbold ..... 256/22

FOREIGN PATENT DOCUMENTS

2528921 * 12/1983 (FR) ..... 403/297

* cited by examiner

*Primary Examiner*—Harry C. Kim
(74) *Attorney, Agent, or Firm*—Thompson Hine LLP

(57) ABSTRACT

A bracket for coupling a first member to a second member having an opening for receiving the first member. The bracket is generally "U" shaped and has a first leg and a second leg such when the legs are spaced apart the first leg engages the first member and the second leg engages the second member to couple the first and second members together.

21 Claims, 10 Drawing Sheets

ATTACHMENT BRACKET

The present invention is directed to a bracket for coupling a pair of rail members, and more particularly, to a bracket for adjustably coupling a fence post and a fence rail.

BACKGROUND OF THE INVENTION

Ornamental fences are widely used for security and aesthetic purposes. However, professional fence installers are often required to install an ornamental fence, and their relatively high hourly rates significantly contribute to the final cost of the fence. Accordingly, it is desired to minimize the time required to install a fence, or to enable a homeowner to install a fence himself or herself, thereby eliminating payments to the fence installer.

In particular, improvements in the forming of structural connections when installing fences are needed to increase the ease of installation. For example, existing methods for attaching a fence rail to a fence post often require the field drilling of holes and passing fasteners through the holes, or aligning pre-drilled or pre-welded joints. These operations usually require extensive use of tools and can be time consuming. Furthermore, the use of pre-drilled or pre-welded components reduces the flexibility to account for any variations or out-of-range tolerances in the fence components. Accordingly, there is a need for an attachment bracket for attaching a fence rail to a fence post in a fast, efficient and adjustable manner.

When installing a fence on a hill or uneven terrain, the fence must be angled to match the inclination angle. An inclined fence is typically either rigidly prefabricated to match the incline, or is constructed with a series of hinged connections that allow the fence to pivot within a predefined range to match the ground angle. The former method requires precise measurements and minimizes any flexibility in the fence to allow for fine adjustments. The latter method typically incorporates a series of simple pin connections to give the fence its flexing ability. However, the pin connections often do not easily rotate, and may bind during attempted rotation. Furthermore, the pins extend outwardly from the fence, and provide a surface upon which clothing or other items may catch. Finally, the exposed pin heads are unsightly and subject to rust. Accordingly, there is a need for a connector for coupling various fence components which allows easy, unimpeded rotation of the fence components, and which remains generally hidden from view.

In order to securely anchor a fence post into the ground, a hole is typically dug in the ground, the fence post is set in the hole, the post is leveled and adjusted, and the hole is filled with concrete to encase the post. However, such an operation usually requires two separate contractors: one contractor to dig the hole and pour the concrete (the concrete contractor), and another contractor to precisely locate, adjust and fix the fence post locations (the fence installer). This division of labor is necessitated by union rules, as well as varying skills of the laborers. Such an arrangement requires both contractors to work together at the same time, and causes difficulties in scheduling, contractor availability, on-site space constraints, and requires one contractor's progress to depend upon the other's progress. Alternately, the concrete contractor may set the fence posts in the poured concrete without assistance from the fence installer. Once the concrete has set, the fence installer may mount the various fence components to the fence post. However, this method limits the fence installer's ability to adjust the location of the posts, and the fence installer must use various methods to fit the fence components to existing post locations. Accordingly, there is a need for a foundation for receiving a fence post and a method of installing a fence post which enables the concrete contractor to pour the foundation independently of the fence installer's locating and fixing of the fence posts.

SUMMARY OF THE INVENTION

The present invention is a bracket for coupling a fence rail to a fence post that enables the position of the rail to be adjusted relative the post, and is also quick and easy to install. The bracket can slide along the fence rail, which enables the position and effective length of the rail to be adjusted relative to the post.

In particular, the present invention is a bracket for coupling a first member to a second member having an opening for receiving the first member. The bracket is generally "U" shaped and has a first leg and a second leg such when the legs are spaced apart the first leg engages the first member and the second leg engages the second member to couple the first and second members together. The bracket is preferably sized to fit within the rail.

The present invention is also directed to a spool for coupling a fence picket to a fence rail. The spool is received in the rail, and the picket is passed through an opening in the spool. In this manner, the picket is coupled to the rail for rotation. The spool is recessed in the rail, easy to install, and guides the picket rotation in a smooth manner.

In particular, the present invention is a spool for coupling a fence picket to a support member, the spool comprising a generally cylindrical body having an opening generally perpendicular to the longitudinal axis of the cylindrical body. The picket may be passed through the cylindrical body at the opening, and the spool is sized to fit within the support member to guide rotation between the picket and the support member.

The present invention is also foundation for receiving a fence post and a method of installing a fence post that enables the foundation to be poured separately from the installation of the fence post. That is, the concrete contractors may dig the required holes and fill them with concrete. The fence installers may then appear at their convenience to install the fence posts securely into the foundations poured by the concrete contractors. This enables the concrete contractors to work independently of the fence installers, while still providing the fence installer the ability to locate the fence posts. The resultant fence post/foundation combination is relatively strong and durable.

In one embodiment the invention is a reinforcing member for strengthening a foundation for a fence post, the reinforcing member being shaped to fit into a hole that is to be filled with concrete to form the foundation having an upper section for receiving the fence post. The reinforcing member comprises an upper portion for strengthening the concrete at the upper section of the foundation, and a lower portion that rests on the bottom of the hole and supports the upper portion.

Other objects and advantages of the present invention will become apparent from the following description, the accompanying drawings and the appended claims.

DETAILED DESCRIPTION

Figure 3:
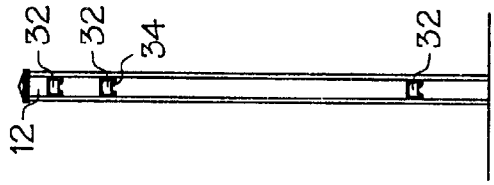
FIG. 3 is an end view of a post of the fence of FIG. 1.
Figure 2:
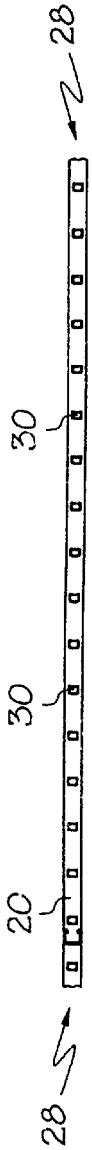
FIG. 2 is a top view of a rail of the fence of FIG. 1.
Figure 1:
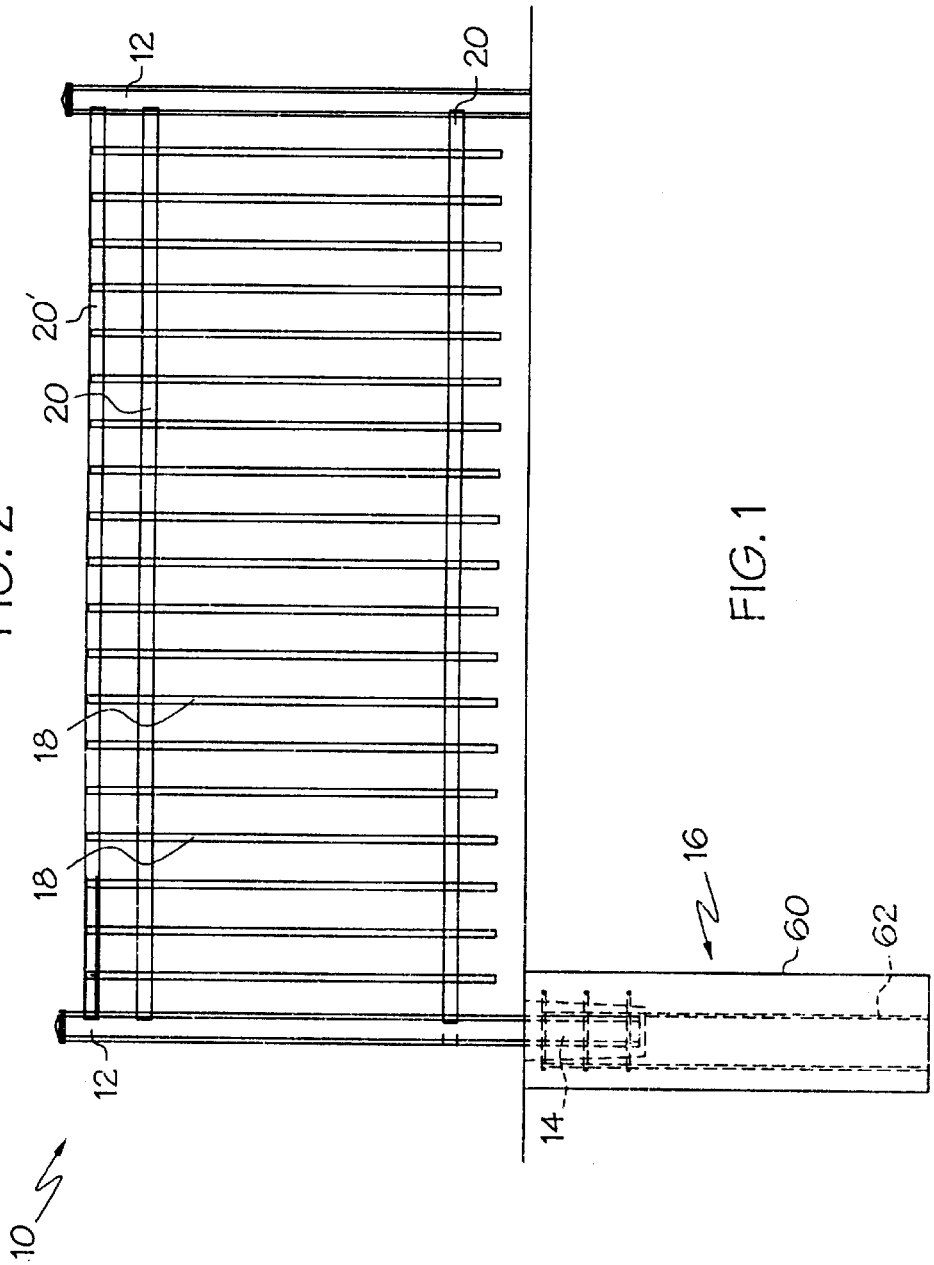
FIG. 1 is a side view of a fence incorporating the attachment bracket, spool, and reinforcing member of the present invention.
Figure 7:
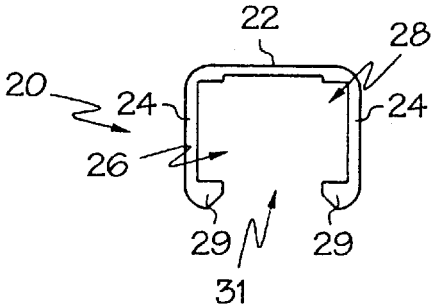
FIG. 7 is an end view of the rail of FIG. 2.
Figure 9:
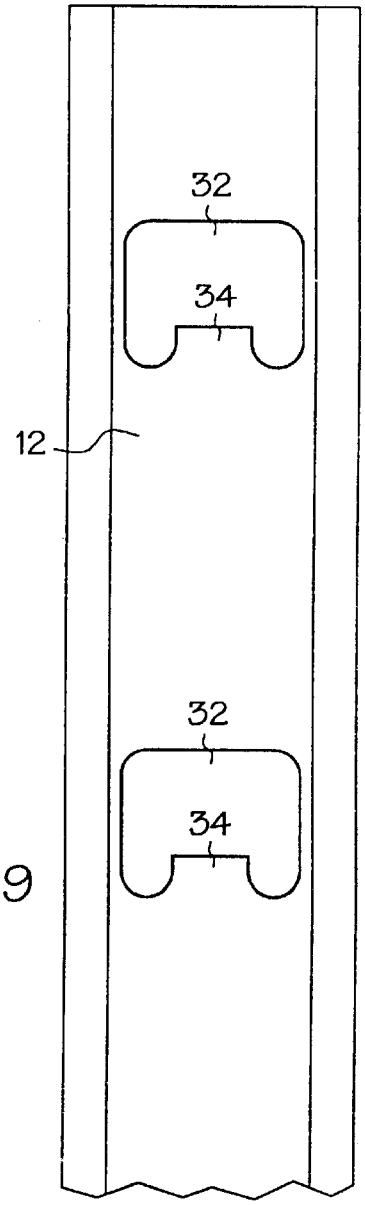
FIG. 9 is a detail end view of the post of FIG. 3.

As shown in FIG. 1, a typical fence 10 comprises a plurality of generally vertically extending posts 12 that are anchored into the ground. However, it is to be understood that the invention may be used with a variety of fences, and the fence 10 of FIG. 1 is only one type of fence that may be used with the invention. Each post 12 has a base 14 that is received in a reinforcement 16. The fence 10 also includes a plurality of vertically extending, spaced pickets 18, and a plurality of generally horizontally extending rails 20 (including top rail 20') extending between each post 12. As shown in FIG. 7, a typical rail 20 has a top panel 22, two side panels 24, and an open channel 26 formed therein. Each rail 20 has a pair of open ends 28 (FIG. 2) and a plurality of laterally extending holes 30 formed therein, through which a picket 18 may be passed. The top rail 20' may lack the holes 30 formed in its top panel 22, as the pickets 18 need not pass through the top rail 20'. Each rail typically includes a pair of inwardly extending flanges 29 extending from the side rails 24. As shown in FIGS. 3 and 9, each post 12 preferably includes a cutout 32 shaped to receive a rail 20 therein, and the cutout 32 defines a flange 34 protruding generally upwardly into the cutout 32.

Figure 4:
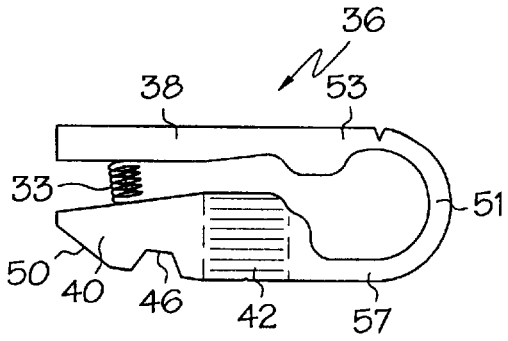
FIG. 4 is a side view of the attachment bracket of the present invention.
Figure 5:
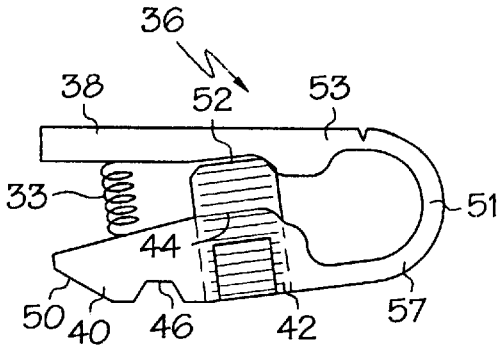
FIG. 5 is a side view of the attachment bracket of FIG. 4, shown with a fastener received therein.
Figure 6:
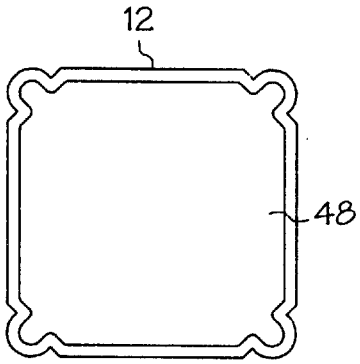
FIG. 6 is a top view of the post of FIG. 3.

The bracket 36 of the present invention is shown in detail in FIGS. 4–5, and may be used to couple a rail 20 to a post 12. The bracket 36 is generally U-shaped and includes a first leg 38 and a second leg 40. The second leg 40 has a hole 42 formed therein to receive a threaded fastener 44 (FIG. 5). The second leg 40 also includes a notch 46 shaped to fit over the flange 34 in a cutout 32 in a fence post 12. The bracket 36 has a head 51 that includes an upper portion 53 and a lower portion 57. The bracket 36 is preferably formed from a corrosion-resistant material, such as aluminum, although a variety of other materials may be used, such as stainless steel or other metals, plastics, compounds, and treated wood.

Figure 10:
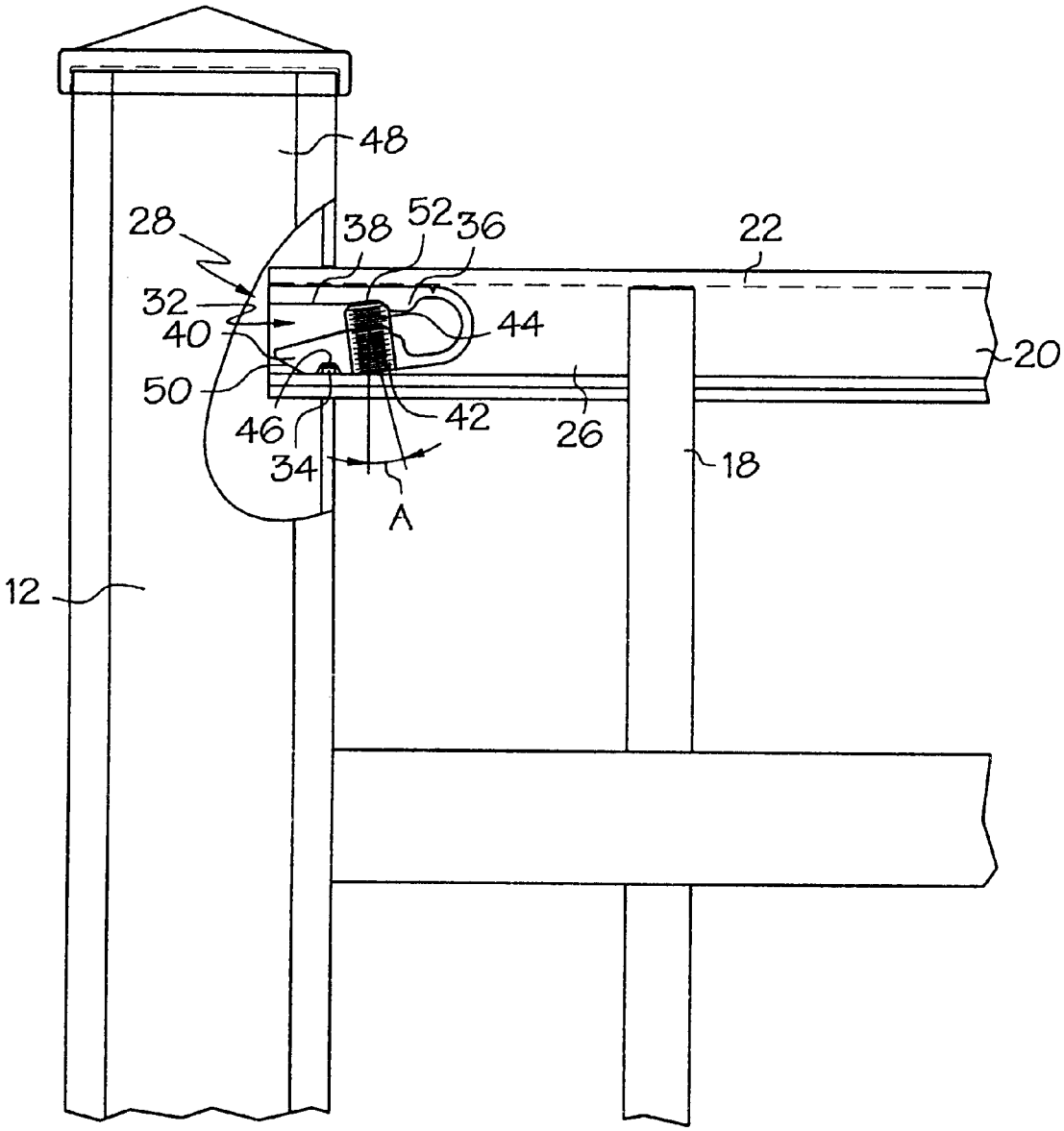
FIG. 10 is a side, partial cross sectional view of fence of FIG. 1, showing the attachment bracket of the present invention.

In order to couple a rail 20 to a post 12, the bracket 36 is slid down the open end 28 of a rail 20 (or rail 20') into the open channel 26. The rail 20 is then slid into the cutout 32 in the post 12, as shown in FIG. 10. The rail 20 may be inserted into the post 12 at any desired depth; that is, the rail 20 may extend into the interior 48 of the post 12 as far as desired. This is accomplished by sliding the bracket 36 within the channel 26 to the desired position. Once the rail 20 is located as desired, the bracket 36 is urged into the interior 48 of the post 12 until the notch 46 fits over the flange 34 of the post 12. In some cases, the ramp 50 on the front side of the second leg 40 rides up along the flange 34 until the flange 34 snaps in place in the notch 46.

Once the bracket 36 is properly positioned and the flange 34 is received in the notch 46, a threaded fastener 44 is passed through the hole 42 in the second leg 40. The fastener 44 is preferably a socket head cap screw, but other types of fasteners may be used. The fastener 44 is rotated until the end 52 of the fastener engages the first leg 38. Continued rotation of the fastener 44 forces the first leg 38 and the second leg 40 apart, and the rotation continues until the bracket 36 is sufficiently locked in place. At this point, the bracket 36 is held in place due to the frictional engagement between the first leg 38 and underside of the top panel 22 of the rail 20, and the engagement of the flange 34 and notch 46. Furthermore, a third point of contact is preferably provided by the upper portion 53 of the head 51 engaging the underside of the top panel 22 of the rail 20, or by the lower portion 57 of the head 51 engaging the flanges 29 of the rail 20. The engagement of the head 51 with the rail 20 provides a third point of contact that helps to stabilize the bracket 36 in the rail 20.

In certain situation, particularly when using relatively small rails, the second leg 40 of the bracket 36 is preferably sized so as to fit between the opening 31 between the two flanges 29 (FIG. 7). It may be necessary for the second leg 40 to fit between the flanges 29 so that the second leg leg 40 can extend downwardly enough to engage the flange 34. In this case, the width of the second leg 40 may be reduced so enable it to fit through the opening 31. However, the head 51 preferably remains wider than the opening 31 to prevent the bracket 36 from falling through the opening 31, and to provide a surface that can bear upon the flanges 29 when the bracket is in the locking position.

As best shown in FIG. 10, the hole 42 for receiving a fastener 44 forms a slight angle A with a vertical plane. The angle A allows a tool (not shown) that is used to tighten the fastener to diverge from the post 12. This divergence provides the necessary spacing between the tool and the post 12 to allow the tool to be operated; i.e. in a hand operated tool, this allows the operator to fit his or her hand between the tool and the post 12 when grasping the tool. It is to be understood that other means beyond those described specifically herein may be used for spreading the legs, such as the use of a spring 33 or other biasing member.

Figure 12:
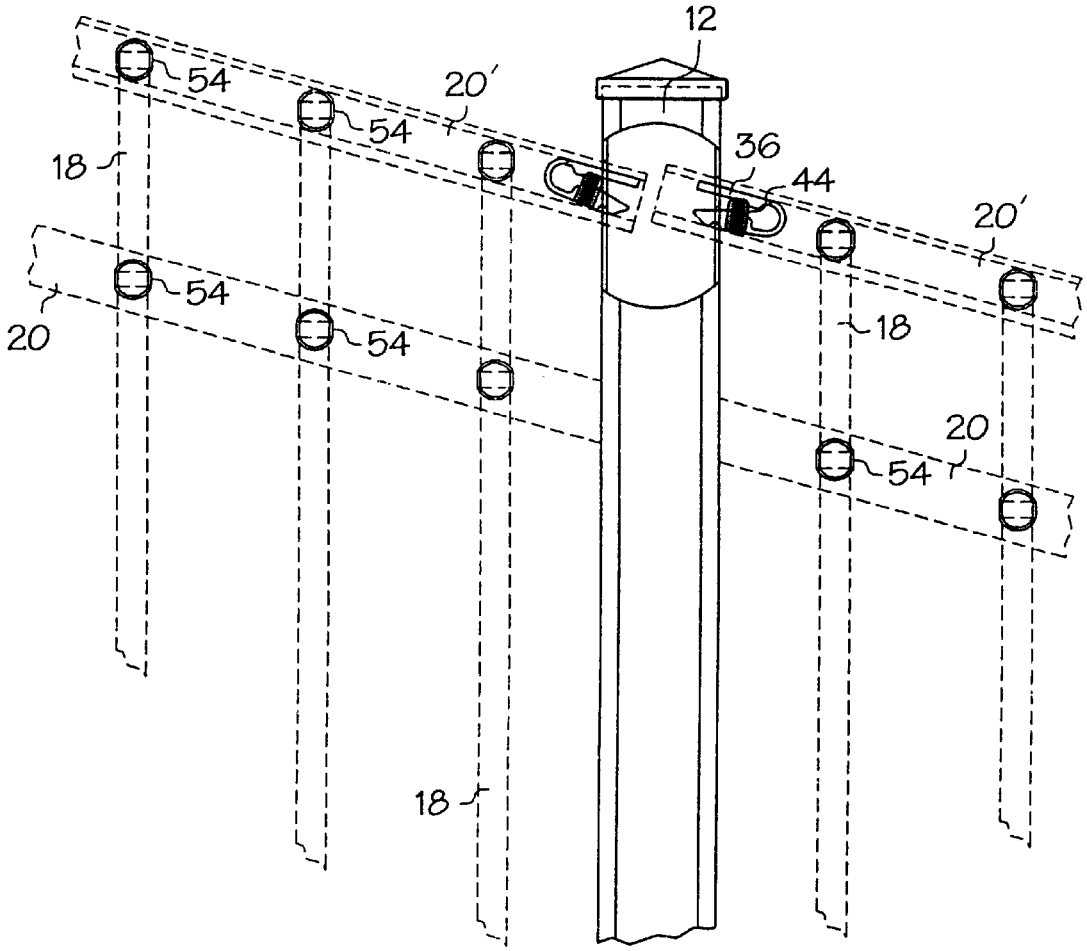
FIG. 12 is a detail of the encircled area of FIG. 11.

Once properly mounted, the bracket 36 secures the rail 20 and post 12 together. The bracket 36 can also pivot to accommodate an angle formed between rail 20 and the post 12, such as shown in FIG. 12. The bracket 36 of the present invention may be used with a top rail 20' as well as the other rails 20 in the fence. The bracket 36 may be used to couple a rail 20 to any body that has an appropriate opening to receive the bracket 36 and that has a flange to fit into the groove 46 in the bracket 36. For example, the bracket 36 may be used to couple a rail 20 to a wall that has an opening formed therein.

Figure 8:
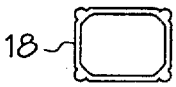
FIG. 8 is a top view of a picket of the fence of FIG. 1.
Figure 11:
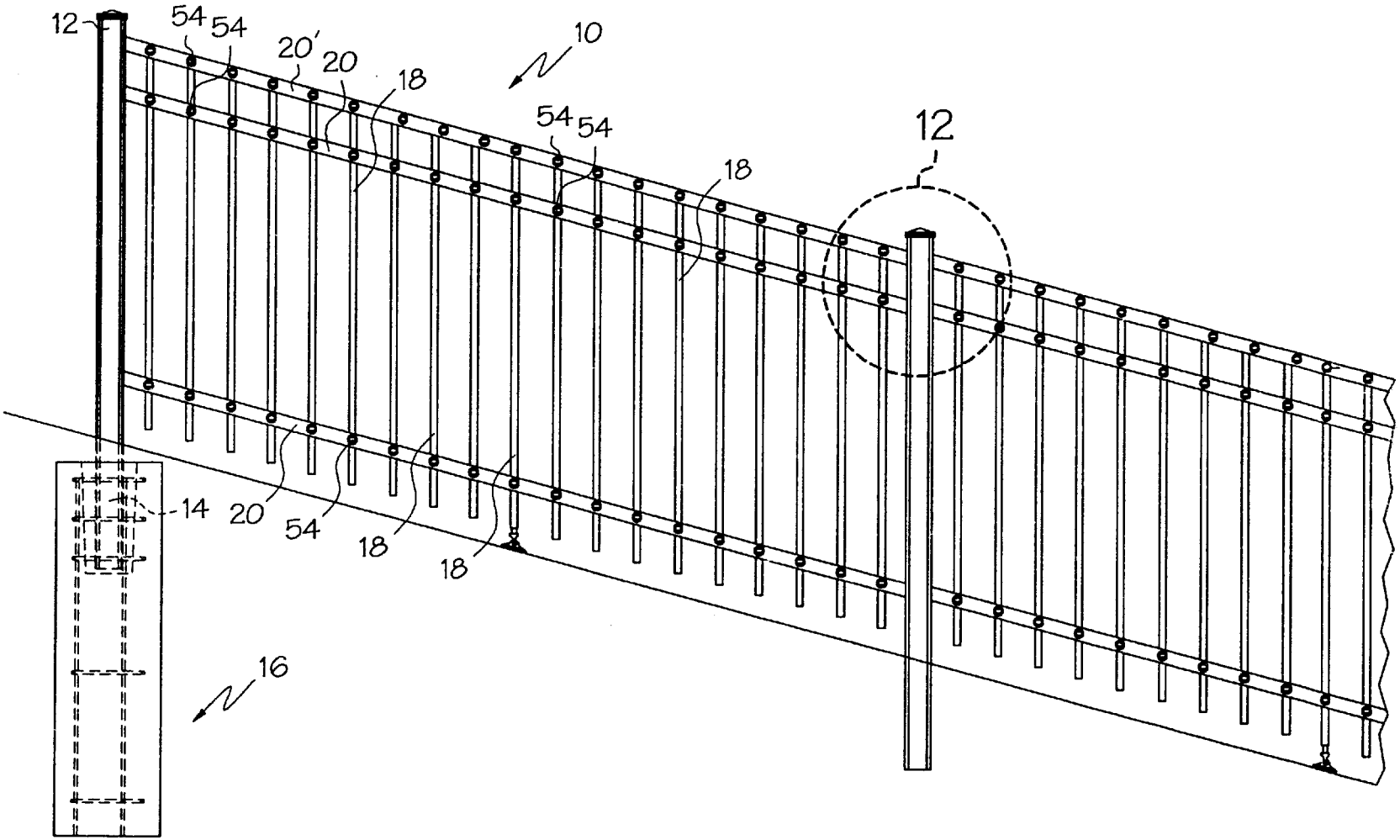
FIG. 11 is a side view of a fence incorporating the attachment bracket, spool, and reinforcing member of the present invention.
Figure 13:
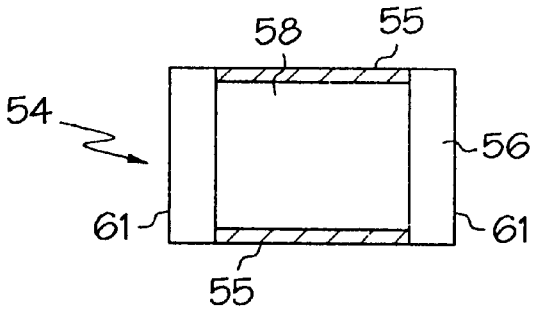
FIG. 13 is a top view of the spool of the present invention.
Figure 14:
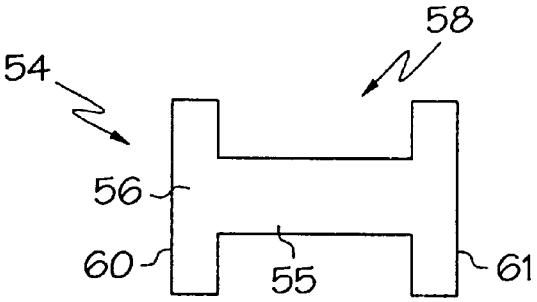
FIG. 14 is a side view of the spool of FIG. 13.
Figure 15:
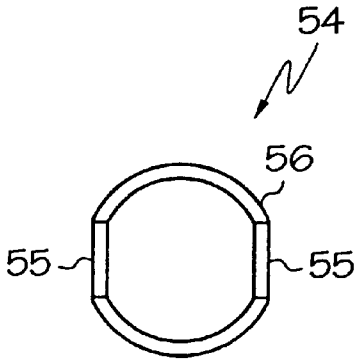
FIG. 15 is an end view of the spool of FIG. 13.
Figure 16:
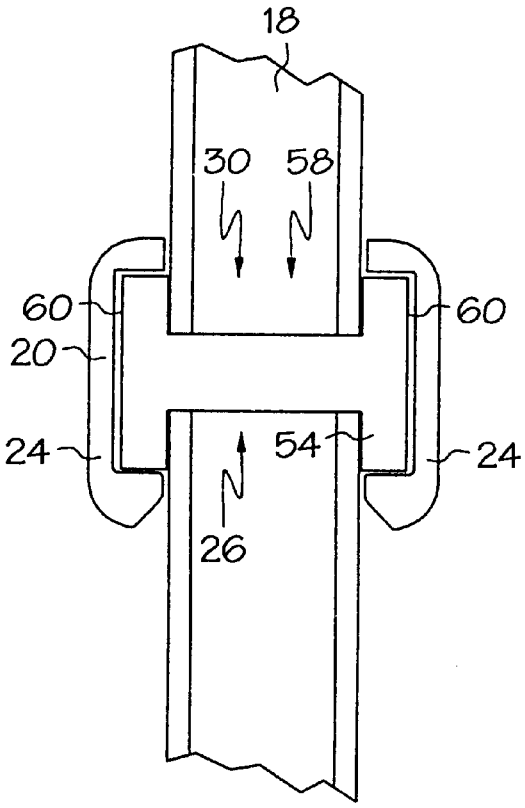
FIG. 16 is a side view of the spool of FIG. 13, shown in a rail and receiving a picket therein.
Figure 17:
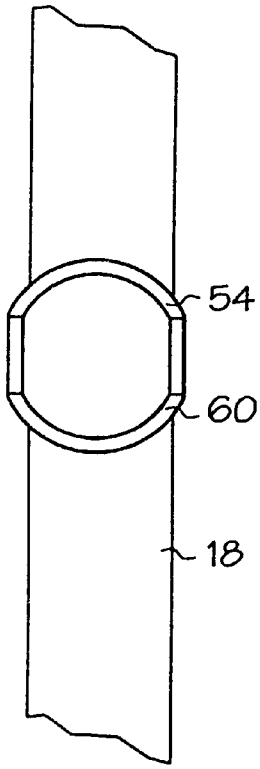
FIG. 17 is an end view of the spool of FIG. 13, shown receiving a picket therein.

As shown in FIG. 11, a fence 10 must often be mounted on a hill or incline. When matched to the angle of incline, each rail 20 forms an angle with the posts 12 and pickets 18. The fence 10 shown in FIG. 11 incorporates a spool 54 at each intersection of a rail 20 and a picket 18 to guide the relative rotation between the rails 20 and pickets 18. The spool 54 ensures smooth rotation, which allows the rails 20 and pickets 18 to assume a variety of angles without binding during rotation. The spool 54 of the present invention is shown in FIGS. 13–15, and includes a generally cylindrical body 56 having an opening 58 generally perpendicular to the longitudinal axis of the cylindrical body 56. The opening 58 is shaped to allow a picket 18 (FIG. 8) to pass through the opening 58. The generally cylindrical body 56 may include a pair of flats 55. The spool 54 is also sized to be received within the open channel 26 in a rail 20 (FIG. 16). In order to properly mount the spool 54 in a rail 20, the spool 54 is slid into the channel 26 at an end 28 of the rail 20 such that the ends 60 of the spool 54 are against the side panels 24 of the rail 20. The spool 54 is moved down the length of the rail 20 until its opening 58 is aligned with the holes 30 formed in the rail 20. The picket 18 is then passed through the holes 30 in the rail 20 (FIG. 2) and the opening 58 in the spool 54 (FIG. 16). The pickets 18 are then preferably fixed to the spools 54 by welding, bonding, or other attachment methods to secure the pickets 18 in the fence. Once the picket 18 is passed through the spool 54, the picket 18 may be rotated relative the rail 20, and the spool 54 guides the relative rotation. As shown in FIG. 12, a spool 54 may be mounted at each rail/picket interface to guide the rotation, including the intersections of the pickets 48 and the top rail 20'. Once the posts 12, pickets 18 and fence rails 20 are mounted as shown in FIG. 12, the rails 20 may be rotated relative the pickets 18 as guided by the spools 54. Furthermore, because each spool 54 is recessed inside a rail 20, it is generally hidden from view, which provides a uniform outer surface and does not provide a surface upon which clothing may catch. The spool 54 is preferably formed from a corrosion-resistant material, such as aluminum, although a variety of other materials may be used, such as stainless steel or other metals, plastics, ceramics, compounds, and treated wood.

Figure 18:
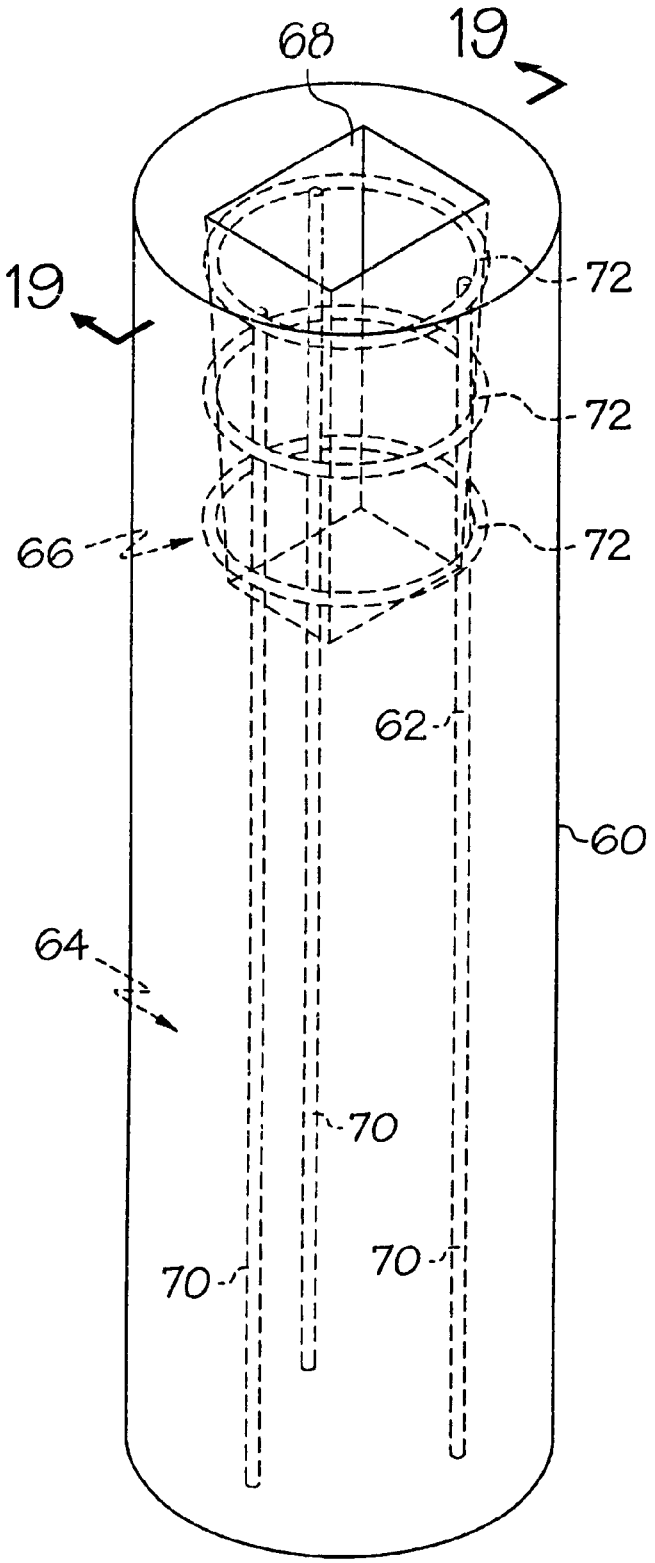
FIG. 18 is a perspective view of the reinforcing member of the present invention, shown in a hole and receiving a form.

The fence posts 12, as shown in FIG. 1, are mounted in a foundation 16 that is typically formed of concrete. The foundation 16 provides a base into which the posts may be securely mounted. To form the foundation 16 of the present invention, a hole 60 is first dug in the ground and a reinforcing member, or wire cage 62, is set into the hole 60 as shown in FIG. 18. The reinforcing member 62 includes a lower portion 64 and an upper portion 66 that is shaped to receive a form 68 therein. The reinforcing member 62 is generally annular in the illustrated embodiment, and has two or more vertically extending legs 70, as well as a plurality of rings 72 connected to the legs. The reinforcing member 62 is preferably made of steel bars, or woven wire mesh, but any other suitable material may be used, including but not limited to metal, plastics or wood. The lower portion 64 is sized to locate the upper portion 66 at about ground level when the reinforcing member 62 is placed in the hole 60.

Figure 19:
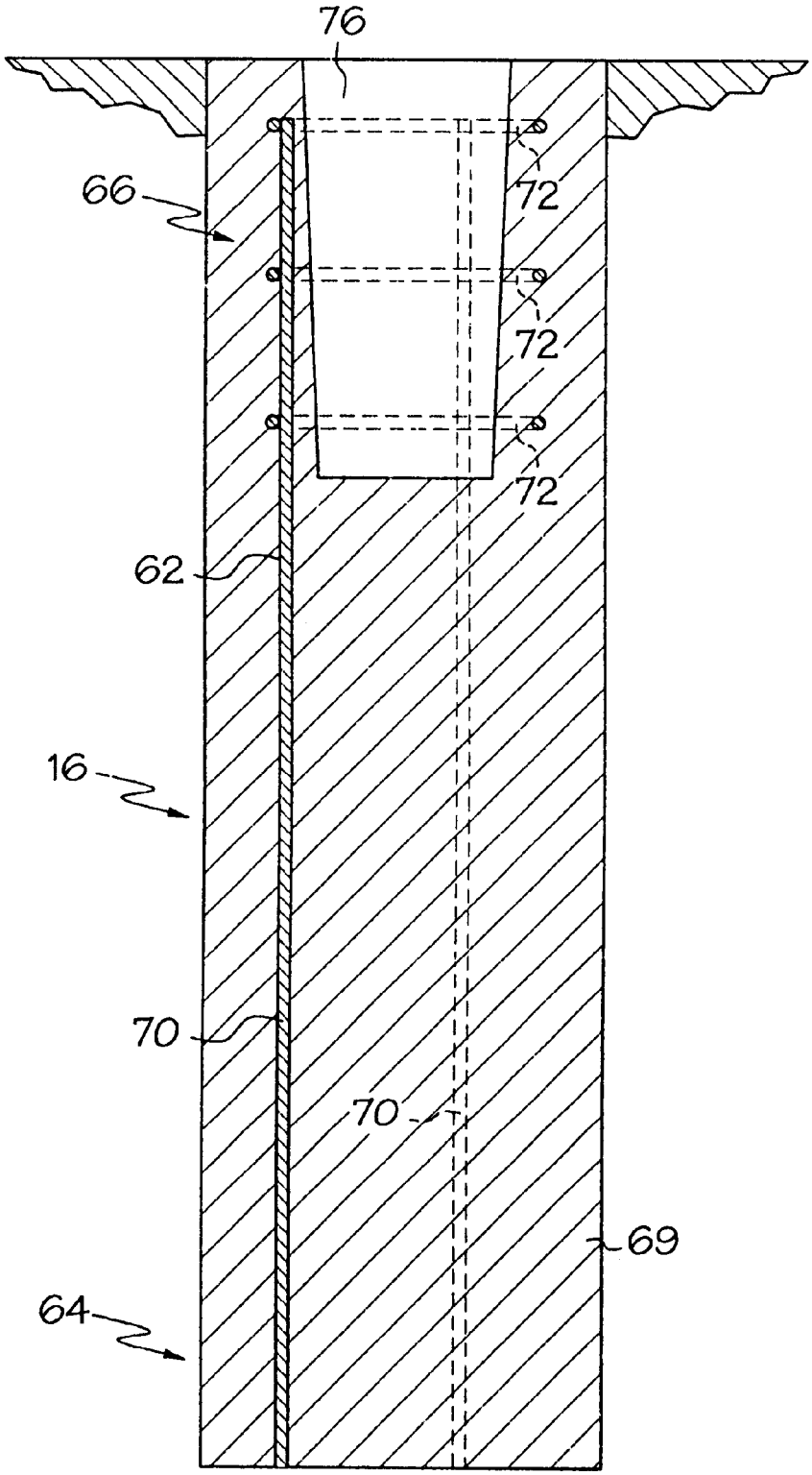
FIG. 19 is a side, cross sectional view of the hole and reinforcing member of FIG. 18, with the hole filled with concrete.

Once the reinforcing member 62 is inserted into the hole 60, the form 68 is inserted into the top portion 66 of the reinforcing member 62. The form 68 may be nearly any acceptable material, such as wood, and is preferably of a larger size than the base 14 of the fence post 12 that is to be mounted in the foundation 16. Once the reinforcing member 62 and form 68 are properly located, the hole 60 is filled with concrete 69 to the top of the form 68 or until the hole 60 is sufficiently filled (FIG. 19). Once the concrete 69 has sufficiently set up, the form 68 is removed, leaving a post socket 76 in the foundation 16. The concrete contractors may then leave the site. Once the concrete 69 is sufficiently cured, the fence contractors may mount the fence posts 12 into the foundation 16, as will be described below.

Figure 20:
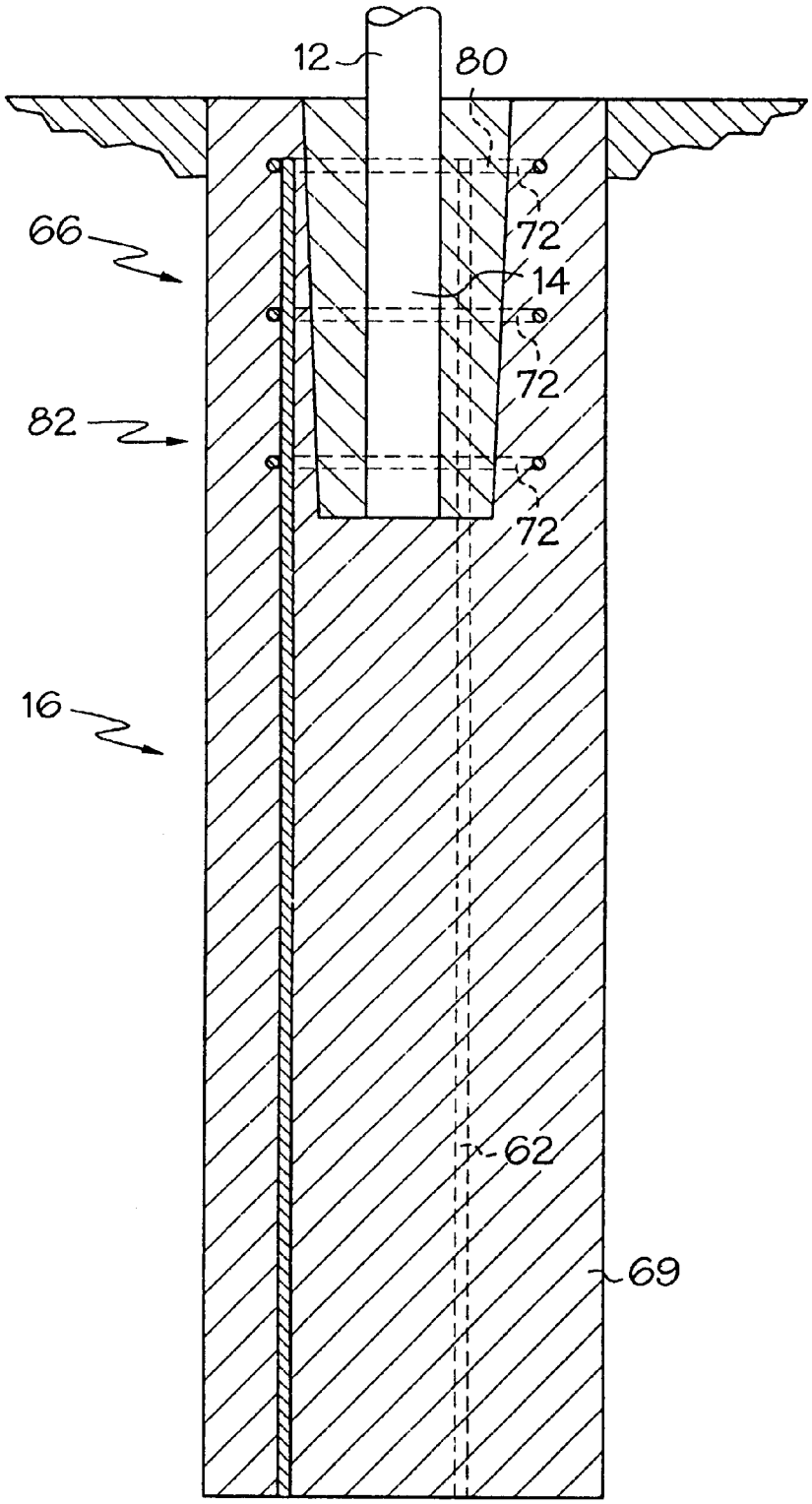
FIG. 20 is a side, cross sectional view of the hole and reinforcing member of FIG. 18, with the hole filled with concrete and receiving a post therein.
Figure 21:
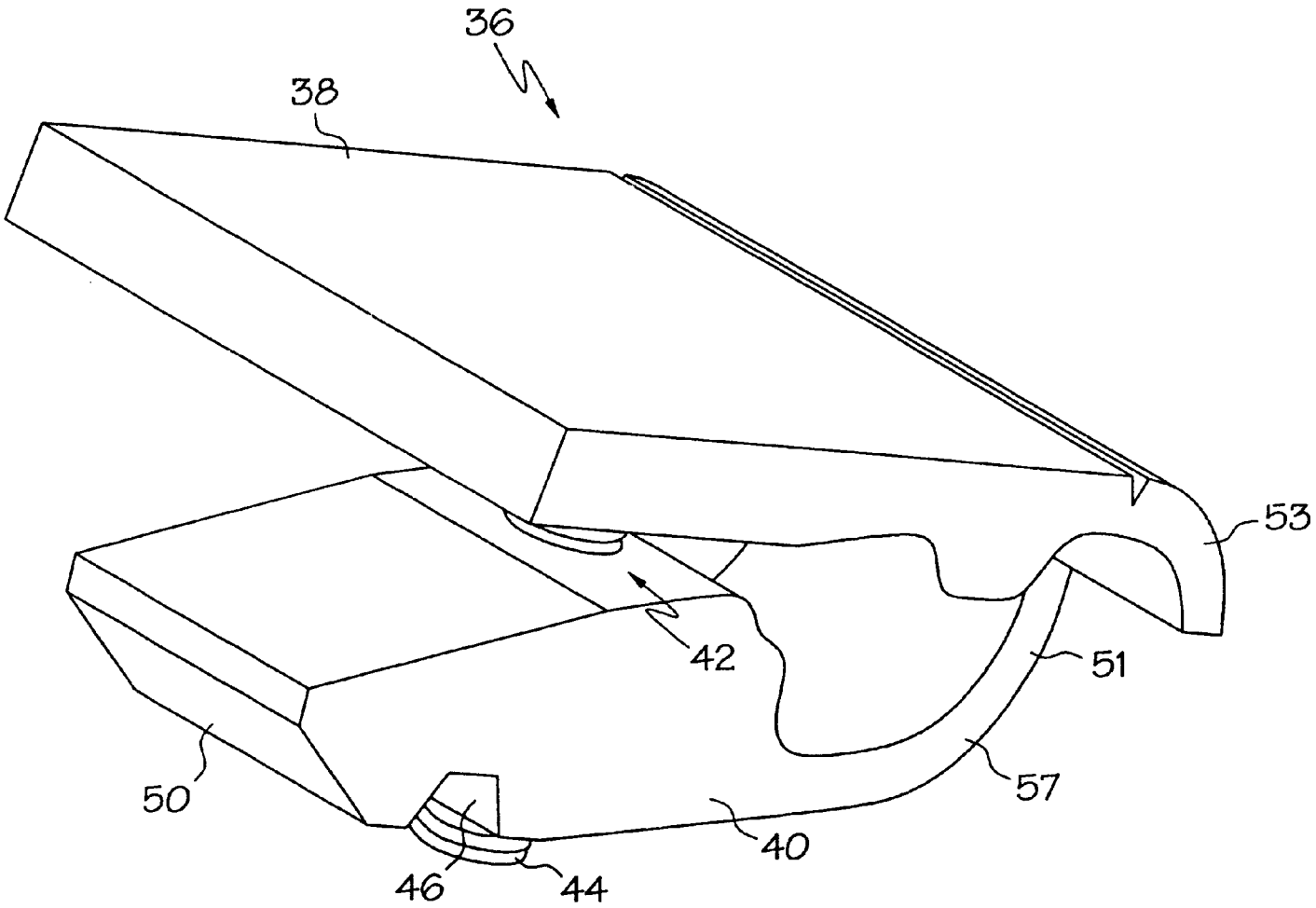
FIG. 21 is a perspective view of the bracket of FIGS. 4–5.

The posts 12 are mounted into the foundation 16 by placing the post 12 into the post socket 76. Because the post socket 76 is larger than the base 14 of the posts 12, the post 12 may be adjusted within the post socket 76 to the desired location (FIG. 20). The socket 76 may be larger than the post base 14 so as to allow the post base to be adjusted in one or more directions only (i.e. the socket 76 is in the form of one or more slots), but the socket 76 is preferably larger than the post base 14 in all directions to provide maximum flexibility. This flexibility in the lateral positioning of the posts 12 allows the installer to account for variations in dimensions of the various fence components. Once the post 12 is in the desired location, it is held in place while the post socket 76 is filled with grout 80, concrete, plaster, mortar, cement, or other similar setting agents. Union rules allow a fence contractor to pour grout in these quantities, although they are generally not permitted to pour the concrete that forms the foundation 16. Once the grout 80 in the socket 76 is set up, installation of the fence post 12 is then completed. The rings 72 in the reinforcing member provide support around the post base 14 and upper section 82 of the foundation 16. This support helps to keep the grout 80 and post 12 securely in place, and reduces chances of the post 12 being shaken loose by impact, wear or weather conditions. Grout may not, by itself, normally be strong enough to hold the fence post 12 in place. However, the grout 80, in combination with the concrete 69 and top portion 66 of the reinforcing member 62, are strong enough to sufficiently anchor the fence post 12. Once the grout is cured, the remaining fence components may be mounted to the posts 12.

The upper portion 66 of the reinforcing member may assume a variety of shapes beyond those discussed herein. For example, the "rings" 72 may be square, triangular, or other shapes in top view. Furthermore, the rings 72 may be replaced or supplemented with nearly any shape or arrangement of bar members that connect one or more of the leg members 70. The upper portion 66, in any case, should be shaped to reinforce and strengthen the upper section 82 of the foundation 16, and to receive a form 68 during pouring of the foundation. Furthermore, the lower portion 64 of the reinforcing member 62 may assume a variety of shapes beyond those discussed herein. The lower portion 64 need only locate the upper portion 66 at the desired elevation, and may do so by resting in the bottom of the post hole 60 and supporting the upper portion 66 at about ground level.

While the forms of the apparatus described herein constitute a preferred embodiment of the invention, the present invention is not limited to the precise forms described herein, and changes may be made therein without departing from the scope of the invention.

What is claimed is:

1. A railing system comprising:

a first member having an opening;

a second member slidably receivable through said opening; and a bracket for coupling said first member to said second member, said bracket being generally "U" shaped and having a first leg, a second leg and a member located between said legs for spacing said legs apart such when said legs are spaced apart said first leg engages said first member and said second leg engages said second member to urge said first and second members into contact with each other to couple said first and second members together.

2. The system of claim 1 wherein one of said legs includes a hole to receive said member therein, wherein upon sufficient advancement of said member in said hole said member spaces said legs apart.

3. The system of claim 2, wherein said member is a threaded fastener received in said hole.

4. The system of claim 1 wherein said member is a spring for forcing said legs apart.

5. The system of claim 1 wherein said first member has a flange extending into said opening, and wherein said first leg has a notch for receiving said flange when said legs are spread apart.

6. The system of claim 5 wherein said second member has a pair of flange members defining an opening therebetween, and wherein said first leg can extend through said opening to engage said first member.

7. The system of claim 1 wherein said second leg is frictionally held in place against said second member when said legs are spaced apart.

8. The system of claim 1 wherein said second member is a fence rail and said first member is a fence post.

9. The system of claim 1 wherein said bracket is aluminum.

10. The system of claim 1 wherein said second member has a channel formed therein, and wherein said bracket is shaped to be received in said channel such that the relative position of said first and second members may be adjusted by the movement of said bracket in said channel.

11. The system of claim 10 wherein said bracket is wider than said channel such that said bracket is retained in said second member.

12. The system of claim 1 wherein said bracket includes a head that engages said second member when said legs are spaced apart.

13. The system of claim 1 wherein said second member has a channel formed therein and a lower opening that opens into said channel, and wherein said first leg is narrower than said lower opening such that said first leg can fit through said lower opening to engage said first member.

14. A method for coupling a first member to a second member having an opening for receiving said first member, the method comprising the steps of:

providing said first member having a channel and said second member having an opening;

selecting a generally "U" shaped bracket having a first leg a second leg and a member located between said legs for spacing said legs apart;

sliding said bracket into said channel of said first member;

sliding said first member through said opening until said first member is located at its desired position; and spacing said first and said second legs apart such that said first leg engages said first member and said second leg engages said second member to urge said first and second members into contact with each other to couple said first and second members together.

15. A fence comprising:

a plurality of generally vertically extending pickets;

at least one rail coupled to said plurality of pickets and forming an angle with said plurality of pickets;

at least one fixed post coupled to said rail, said post being coupled to said rail by a generally "U" shaped bracket having a first leg and a second leg such that when said legs are spaced apart said first leg engages said rail and said second leg engages said post to couple said first and second members together, said rail including a generally downwardly-opening channel in which said bracket is received, and wherein said post has a flange that is engaged by said bracket when said legs are spaced apart.

16. The fence of claim 15 wherein said post includes an opening that receives said rail therein, and wherein said flange extends into said opening.

17. The fence of claim 15 wherein said first leg frictionally engages said rail when said legs are spaced apart.

18. The fence of claim 15 wherein said legs are spaced apart by a member located between said legs.

19. The fence of claim 15 wherein said rail includes a plurality of holes through which said pickets are received.

20. A railing system comprising:

a first member having an opening;

a second member having a channel running generally the length of said second member, said second member being slidably receivable through said opening; and a bracket for coupling said first member to said second member, said bracket being generally "U" shaped and having a first leg and a second leg such when said legs are spaced apart said first leg engages only first member in or adjacent to said channel and said second leg engages only said second member to couple said first and second members together.

21. The railing system of claim 20 wherein said bracket urges said first member into contact with said second member to couple said first and second members together.

* * * * *